US005954019A

United States Patent [19]

Yoshikawa et al.

[11] Patent Number: 5,954,019

[45] Date of Patent: Sep. 21, 1999

[54] VARIABLE VALVE TIMING ARRANGEMENT FOR ENGINE

[75] Inventors: Masaaki Yoshikawa; Hironao Takahashi, both of Iwata, Japan

[73] Assignee: Yamaha Hatsudoki Kabushiki Kaisha, Iwata, Japan

[21] Appl. No.: 08/998,884

[22] Filed: Dec. 29, 1997

[30] Foreign Application Priority Data

Dec. 26, 1996 [JP] Japan ..... 8-348010

[51] Int. Cl.[6] ..... F01L 1/26; F16K 1/42

[52] U.S. Cl. ..... 123/90.17; 123/90.31; 123/90.34; 123/196 A; 123/196 M

[58] Field of Search ..... 123/90.15, 90.17, 123/90.31, 90.33, 90.34, 196 A, 196 M, 196 R

[56] References Cited

U.S. PATENT DOCUMENTS 4,430,971 2/1984 Holding ..... 123/196 A
5,012,773 5/1991 Akasaka et al. ..... 123/90.17
5,144,921 9/1992 Clos et al. ..... 123/90.34
5,209,193 5/1993 Uchida et al. ..... 123/90.34
5,540,197 7/1996 Golovatai-Schmidt et al. .... 123/90.31
5,765,518 6/1998 Nakano ..... 123/90.17
5,775,285 7/1998 Takahashi ..... 123/196 A
5,785,026 7/1998 Moriya ..... 123/90.17

*Primary Examiner*—Weilun Lo
*Attorney, Agent, or Firm*—Knobbe, Martens, Olson & Bear LLP

[57] ABSTRACT

A twin overhead camshaft internal combustion engine embodying a variable valve timing mechanism on each of the camshafts. The variable valve timing mechanism is operated hydraulically by lubricant that is supplied to it through a bearing surface of the camshaft so as to minimize external conduits and connections and to simplify sealing.

12 Claims, 6 Drawing Sheets

VARIABLE VALVE TIMING ARRANGEMENT FOR ENGINE

BACKGROUND OF THE INVENTION

This invention relates to an internal combustion engine and more particularly to a variable valve timing mechanism for an engine.

In order to improve the performance of internal combustion engines, not only in terms of power output but also in terms of fuel economy and exhaust emission control, it has been proposed to employ variable valve timing mechanisms. These mechanisms permit adjustment of the timing of opening and closing of the intake and/or exhaust valves during the running of the engines. This permits the valve timing to be set optimum for a wide variety of running conditions.

One popular type of variable valve timing mechanism is interposed in the arrangement that couples the engine output shaft to the camshaft. A hydraulically actuated mechanism is interposed in the drive so as to vary the phase relationship between the camshaft and the element which drives it.

Obviously, it is necessary to supply hydraulic fluid to this variable valve timing mechanism for its operation. This involves not only the supply of pressurized fluid but also a return path for returning the fluid from the variable valve timing mechanism during the adjusting cycle.

Frequently, these hydraulic connections are done either externally or in a cover plate of the engine. This gives rise to a number of difficulties. First, the connections may be positioned in an area where they can be damaged. Secondly, there are additional couplings and thus the likelihood of leakage.

It is, therefore, a principal object of this invention to provide an improved hydraulic operating mechanism and supply system for a variable valve timing mechanism of an internal combustion engine.

It is a further object of this invention to provide an improved arrangement for transmitting and discharging actuating hydraulic fluid to the variable valve timing mechanism of an internal combustion engine.

Frequently, the hydraulic fluid for operating the variable valve timing mechanism is the same lubricant that is also employed to lubricate the engine. Thus, in addition to supplying the hydraulic fluid to the variable valve timing mechanism for its actuation, it is also necessary to supply the same fluid to the bearings of the camshaft for their lubrication as well as for the lubrication of other components associated with the camshaft and engine. This further complicates the overall structure.

It is, therefore, an additional object of this invention to provide an improved and simplified hydraulic supply arrangement for supplying lubricating oil to a camshaft for its lubrication and also for the actuation of the variable valve timing mechanism associated with it.

SUMMARY OF THE INVENTION

A feature of this invention is adapted to be embodied in an internal combustion engine which is comprised of an engine body. A camshaft has at least one bearing portion journaled for rotation in the engine body. The camshaft has at least one cam lobe for operating at least one valve for the engine. A cam drive element is driven by an engine output shaft. A hydraulically operated variable valve timing mechanism adjustably couples the cam drive element to the camshaft for adjusting the timing of the camshaft and for driving the camshaft. Means form a lubricating and a hydraulic supply passage in the engine body which terminate at the cam bearing portion for supplying lubricating oil to the camshaft bearing portion and for supplying actuating lubricant to the hydraulic variable valve timing mechanism for its operation.

DETAILED DESCRIPTION OF THE PREFERRED EMBODIMENT OF THE INVENTION

Figure 1:
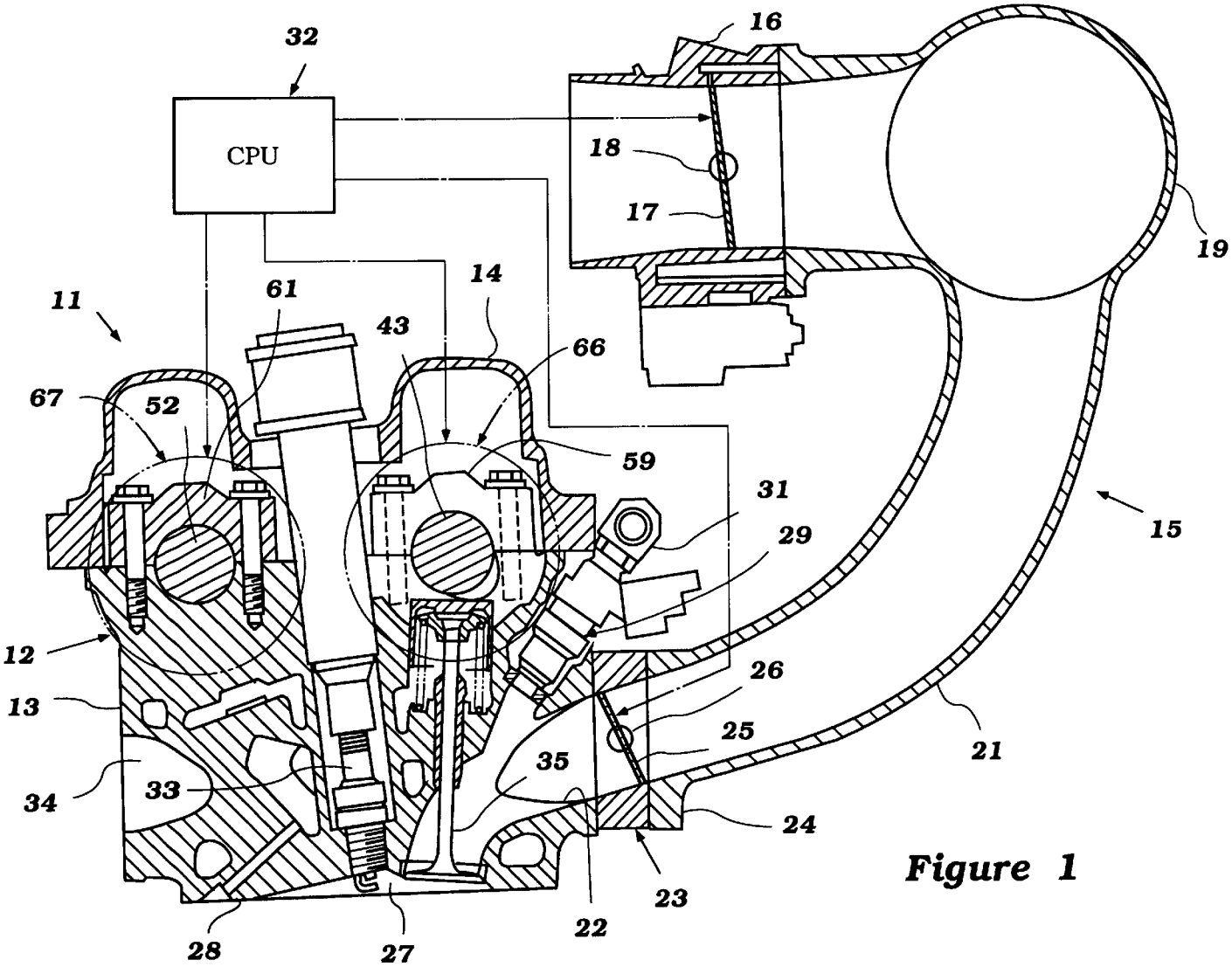
FIG. 1 is a partial view of a portion of an internal combustion engine embodying the invention with parts shown in cross section and other parts shown schematically.

Referring now in detail to the drawings and initially primarily to FIG. 1, a portion of an internal combustion engine constructed in accordance with an embodiment of the invention is identified generally by the reference numeral 11. Since the invention deals primarily with the valve actuating mechanism and since the engine is of the twin overhead camshaft type, only the cylinder head assembly of the engine and certain components associated with it are illustrated. The cylinder head assembly, indicated generally by the reference numeral 12, is comprised of a main cylinder head member 13 and an attached cam cover 14.

The right-hand side of the engine as viewed in FIG. 1 comprises the intake side and a portion of the induction system, indicated generally by the reference numeral 15 is associated therewith. This induction system 15 includes a throttle body 16 which draws atmospheric air through a suitable inlet device which may include a silencing and filtering mechanism and which is not shown since any conventional structure may be employed. A throttle valve 17 is rotatably journaled in the throttle body 16 on a throttle valve shaft 18.

The throttle body 16 delivers air to a plenum chamber 19 from which a plurality of individual runners 21 extend. Each runner serves a respective Siamese-type intake port 22 formed in the cylinder head member 13.

In order to improve engine performance, a flow control valve assembly, indicated generally by the reference numeral 23 is sandwiched between a flange 24 of the manifold runners 21 and the cylinder head 13. This control valve assembly 23 includes a tumble valve 25 that is rotatably supported by a control valve shaft 26. By opening and closing the valve 25, either a tumble motion may be generated in the associated combustion chamber or the charge may be permitted to enter the combustion chamber without substantial restriction.

The charge which is delivered to the cylinder head intake passage 22 is transferred through intake valve arrangements, to be described shortly, into a combustion chamber. This combustion chamber is formed in part by a recess 27 in a lower surface 28 of the cylinder head. The cylinder head surface 28 is affixed in closing relationship to a cylinder block, which is not illustrated and which may be of any known type. The cylinder head recesses 27 cooperate with the associated cylinder bores and pistons to form the engine combustion chambers.

An electrically operated fuel injector, indicated generally by the reference numeral 29 is mounted in the cylinder head 13 and delivers fuel into the intake passage 22. A fuel rail 31 supplies fuel to the fuel injector 29 associated with each of the engine combustion chambers. Fuel is supplied to the fuel rail 31 through a suitable fuel supply system which may be of any known type.

The fuel injector 29 is controlled along with other components of the engine by a CPU, indicated generally by the reference numeral 32, and which is shown only schematically. The CPU 32 may control the operation of the throttle valve 17 and the flow control valve 26 as shown by the schematic broken lines in FIG 1. The strategy by which this is done may be of the type described in the copending application entitled "Valve Timing System For Engine", Serial No. 08/999,450, Filed concurrently herewith and assigned to the assignee hereof (Attorney Docket No. YAMAH4.432A).

A spark plug 33 is mounted in the cylinder head 13 and has its spark gap exposed in the cylinder head recess 27. The spark plugs 33 may be fired by a suitable ignition system which may also be controlled by the CPU 32.

The burnt charge which results from the firing of the spark plug 33 is discharged through one or more exhaust passages 34 formed in the side of the cylinder head 13 opposite from the intake passages 22. The flow into the exhaust passages 34 is controlled by a valve mechanism which will be described shortly.

An exhaust manifold (not shown) is affixed to the exhaust side of the cylinder head 13 for collecting the exhaust gases from the exhaust passages 34 and delivering them to the atmosphere through any suitable exhaust system. For the reasons already noted, this exhaust system is not shown and any known type may be employed in connection with the engine.

The valve mechanism which operates so as to control the flow through the intake passages 22 and the exhaust passages 34 and the interchange of intake and exhaust charge to and from the combustion chamber recesses 27 will now be described by primary reference to FIGS. 1 and 2.

In the illustrated embodiment, the engine 11 is of the 5-valve per cylinder type. Although this type of valve arrangement is illustrated and will be described, it should be readily apparent that the invention can be utilized with a wide variety of types of valve mechanisms and can, in fact, be utilized with engines that do not have overhead valves. Of course, the invention has maximum utility in conjunction with the valve arrangement which will be described.

Figure 5:
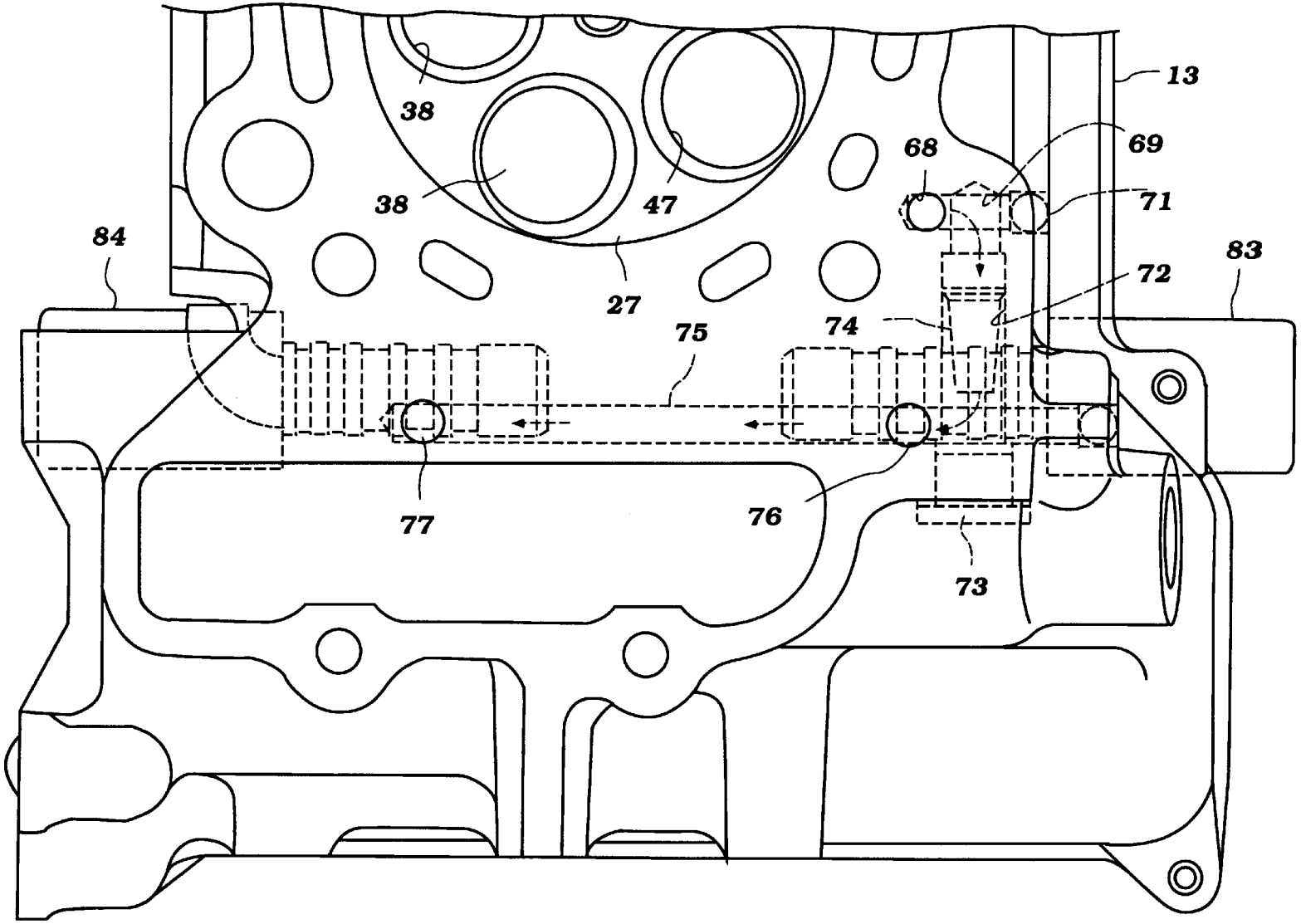
FIG. 5 is a bottom plan view of the portion of the cylinder head shown in FIG. 3 with the same components removed.

The 5-valve per cylinder arrangement is comprised of a three intake valves, each indicated by the reference numeral 35 and two exhaust valves, each indicated by the reference numeral 36. The intake valves 35 include a center intake valve which is shown in FIG. 1 and which is disposed between a pair of side intake valves, one of which is shown in FIG. 2. Preferably, these valves are disposed so that the center intake valve is disposed further from a plane containing the axis of rotation of the engine crankshaft and the axis of the cylinder bores with which the cylinder head recesses 27 cooperate. The side intake valves, on the other hand, are positioned closer to this plane and may in fact extend over it as shown in FIG. 5. The specific relationship can be varied without departing from the invention.

The intake valves 35 have their stem portions slidably supported within guides 37 that are suitably affixed in the main cylinder head member 13 and which form a portion of the cylinder head assembly 12. The intake passage 22 is a Siamese-type and branches into individual branches that terminate at intake ports 38 which terminate in valve seats 39 which are valved by the heads of the respective intake valves 35 in a well known manner.

Each intake valve 35 is urged toward a closed position by a coil compression spring 41. This spring acts against a keeper retainer assembly 42 that is affixed to the stem of the valve 35 and against the cylinder head 13 for urging the valves 35 to their closed positions. An intake camshaft, indicated generally by the reference numeral 43, is journaled within the cylinder head 13 in a manner which will be described shortly. This intake camshaft 43 is also driven by the engine crankshaft in a mechanism which will be described. The intake camshaft 43 has a plurality of cam lobes 44 which are associated with thimble tappets 45 for actuating the valves 35 in a well known manner.

Figure 2:
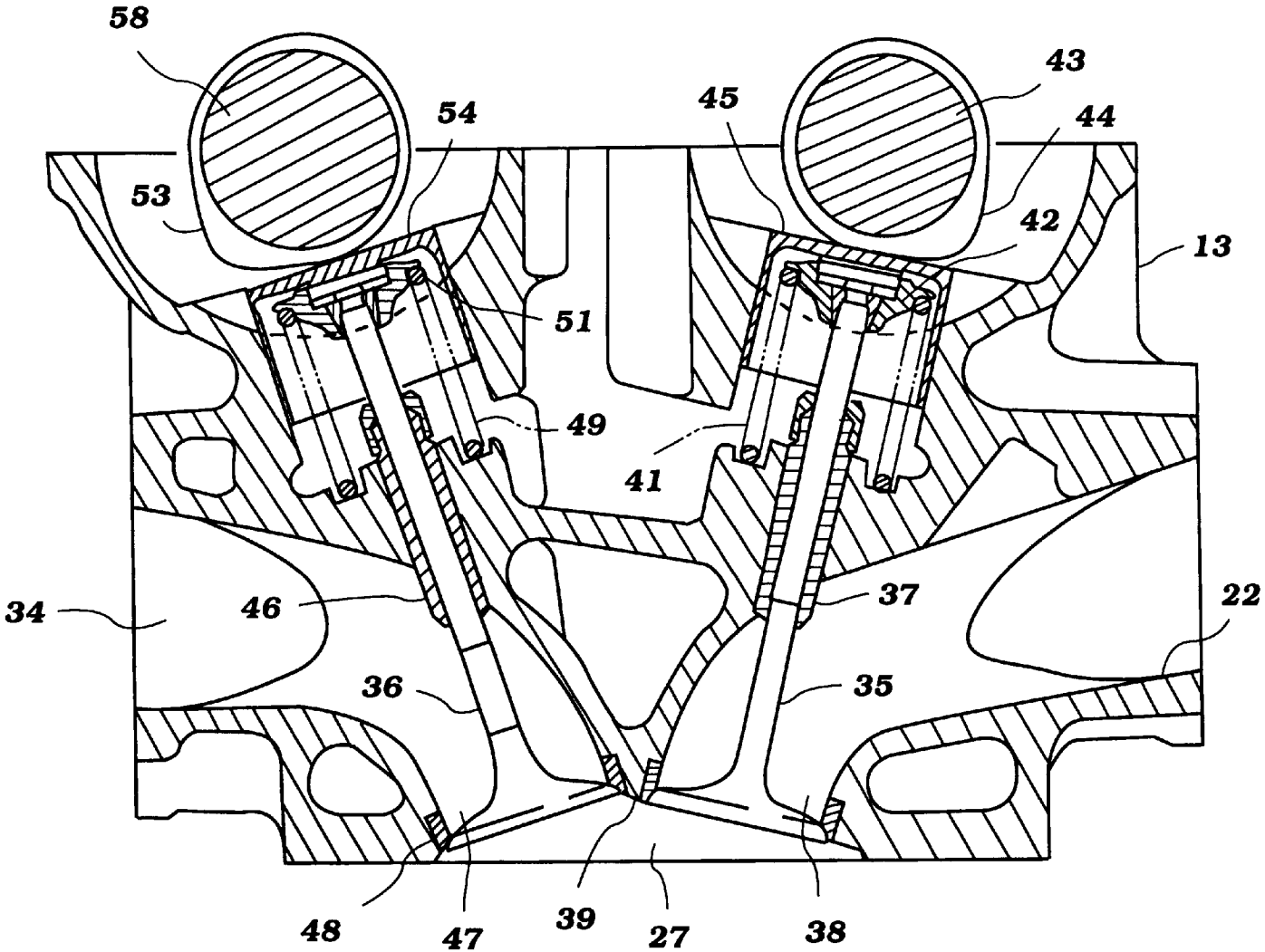
FIG. 2 is an enlarged cross-sectional view taken along a plane parallel to that of FIG. 1 and shows in more detail the valve actuating mechanism for the engine.

Continuing to refer primarily now to FIG. 2, the two exhaust valves 36 are disposed in side-by-side relationship. Like the intake valves 35, the exhaust valves 36 are slidably supported in the cylinder head member 13 by valve guides 46. The heads of the valves 36 control exhaust ports 47 which are formed in the cylinder head 13 in communication with the cylinder head recessed 27 and which terminate at exhaust valve seats 48. Again, this is a type of construction that is well known in the art.

The exhaust valves 36 are urged to their closed positions by coil compression springs 49. These coil compression springs 49 act against keeper retainer assemblies 51 affixed to the stems of the exhaust valves 35 and the cylinder head 13.

An exhaust camshaft 52 is journaled in the cylinder head assembly 12 in a manner which will also be described. The exhaust camshaft 52 rotates about an axis that is parallel to the axis of the intake camshaft 43.

The exhaust camshaft 52 has a plurality of cam lobes 53. Each of these cam lobes 53 cooperates with a respective thimble tappet 54 for controlling the opening of the associated exhaust valve 36 in a manner which is also well known in this art.

The mechanism for journaling and driving the intake and exhaust camshafts 43 and 52, respectively, will now be described by primary reference to FIGS. 3–6. Each of the camshafts 43 and 52 have a plurality of spaced bearing portions formed along their length. Except for the forward-most bearing portions indicated respectively by the reference numerals 55 and 56, these bearing portions have a conventional construction and are journaled a manner similar to the journaling of the portion 55 and 56 which will now be described.

The cylinder head 13 is formed with a plurality of machined bearing surfaces 57 and 58. The end most of these surfaces appear in FIGS. 3, 4 and 6 and cooperate with the camshaft bearing portions 55 and 56 for journaling the intake and exhaust camshafts 43 and 52. Bearing caps, which appear only in FIG. 1 and which are identified by the reference numerals 59 and 61 are affixed by threaded fasteners to the cylinder head 13 and have bearing surfaces which cooperate with the cylinder head bearing surfaces 57 and 58, respectively, for journaling the camshafts 43 and 52 in a well known manner.

Figure 3:
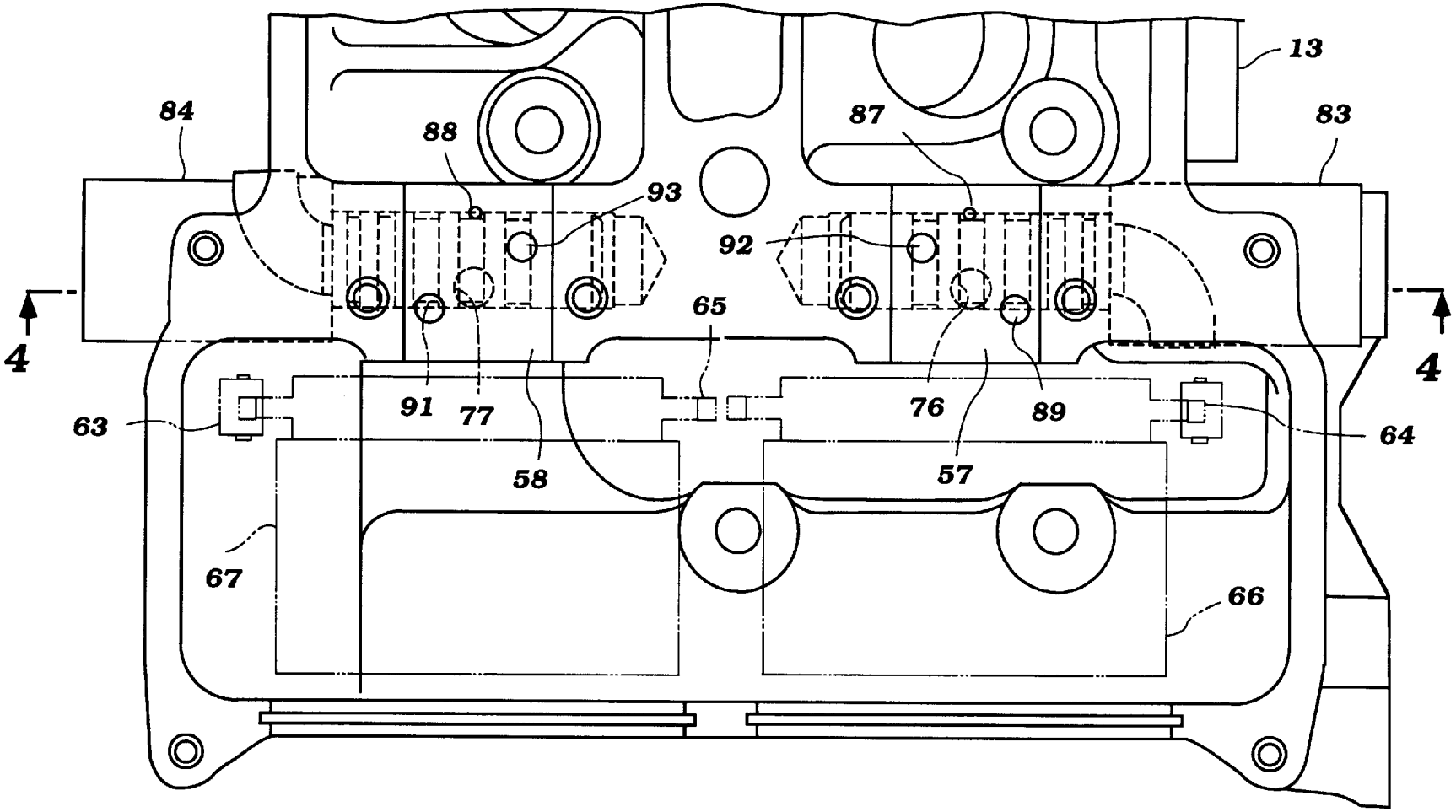
FIG. 3 is a top plan view of the forward portion of the cylinder head with the camshaft removed and with the valve driving mechanism shown in phantom.

The area of the cylinder head 13 adjacent the wall that forms the bearing surfaces 57 and 58 forms in part a timing case cavity 62 into a which a timing chain, shown in phantom in FIG. 3 and indicated generally by the reference numeral 63, extends. The lower end of this timing chain 53 is driven from the crankshaft of the engine either directly or indirectly through an intermediate shaft. This timing chain 63 cooperates with sprockets 64 and 65, formed on respective cam driving and variable valve timing mechanisms indicated generally by the reference numerals 66 and 67, respectively.

These cam driving and variable valve mechanisms 66 and 67 are comprised of hydraulically operated devices that provide mechanical coupling to driving portions 68 and 69 of the camshafts 43 and 52, respectively. However, the variable valve timing mechanisms 66 and 67 are capable of hydraulically adjusting the phase angle between the sprockets 64 and 65 and the camshaft portions 68 and 69.

One way this may be done, although various hydraulically actuated known types of devices may be utilized in conjunction with the engine is by moving a helically splined connection in an axial direction so as to affect the phase angle. These variable valve timing mechanisms 66 and 67 include, therefore, members which may be axially moveable therein under the application of hydraulic pressure to one side or the other and relieving the pressure on the non-pressurized side.

The manner in which that is done will now be described. The engine 11 is supplied with a generally conventional lubricating system which may include an oil tank, for example, the crankcase if the engine is not a dry sump type. An oil pump draws fluid from the oil tank and pressurizes it for circulation through the engine lubricating system. This lubricating system will include, a pressure relief valve and oil filter as is well known in the art.

This lubricating system is employed for actuating both the variable valve timing mechanisms 66 and 67 and also lubricating the bearing surfaces of the camshafts 43 and 52. The portion of the system that lubricate the front bearing surfaces 55 and 56 and supplies hydraulic pressure for the variable valve timing mechanism 66 and 67 is the only portion that will be described since this is, in primary part, the area of the invention.

The lubricating system includes a plurality of main oil galleries that are formed in the cylinder block with which the cylinder head 13 is associated. One of these main oil galleries extends upwardly through the cylinder block and terminates in the cylinder block surface with which the cylinder head surface 28 cooperates. The cylinder head 28 is formed with a drilled passageway which appears in FIG. 5 and which is identified by the reference numeral 68. This passageway is intersected by a cross drilled passageway 69 that is closed by plug 71.

The passageway 69 is, in turn, intersected by a counterbored passageway 72 that extends from the front face of the cylinder head 13 (See also FIG. 4) and which is closed at its outer end by a removable closure plug 73. Contained within a larger diameter portion of the counterbore 72 is a removable filter element 74.

Although the engine has a main oil filter, these oil filters frequently employ bypasses which bypass the filter element if the filter element becomes clogged. Because of this, and because of the closed tolerances of the variable valve timing mechanism 66 and 67, it is desirable if the system for supplying lubricant to them includes an additional, albeit replaceable filter element. Hence, the filter element 74 is inserted into the counterbore 72 and functions to filter the oil that is delivered to the variable valve timing mechanism 66 and 67 through the system which will continue to be described.

Figure 4:
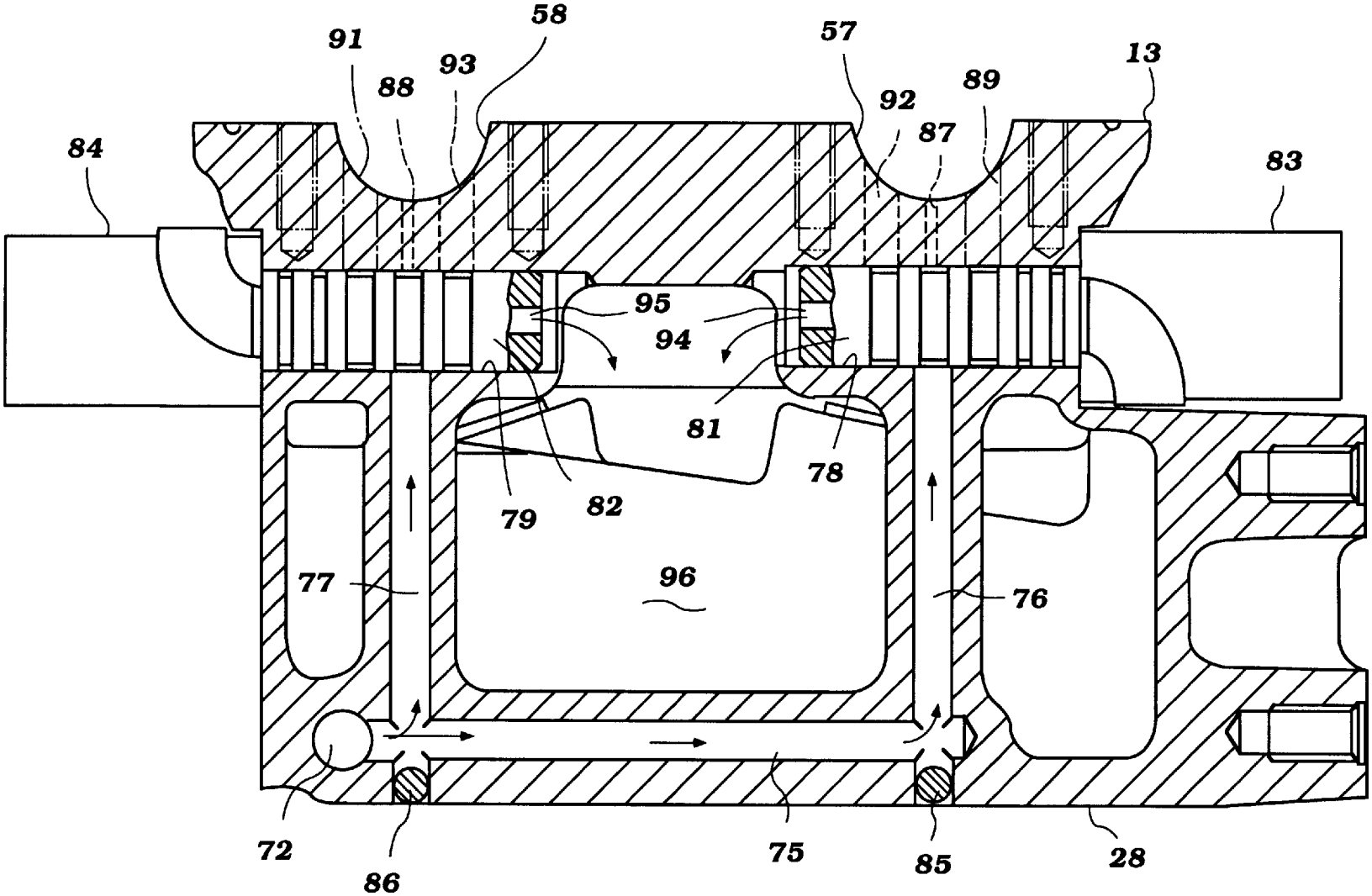
FIG. 4 is a cross-sectional view taken along the line 4—4 of FIG. 3 again showing the camshaft and other components removed so as to more clearly show the construction.

The counterbored passageway 72 is intersected by an oil gallery, indicated by the reference numeral 75 and which is shown best in FIG. 4. Two cross-drilled passageways 76 and 77 are drilled from the cylinder head lower surface 28 toward the bearing recesses 57 and 58, respectively. These drilled passageways 76 and 77 terminate at valve receiving bores 78 and 79, respectively. The lower ends of the drilled passageways 76 and 77 are closed by closure plugs 85 and 86.

Valve spools 81 and 82 are slidably supported in these valve bores 78 and 79 and have respective lands thereon for controlling the flow in the manner to be described. These valve spools 81 and 82 are operated by respective solenoids 83 and 84. The solenoids 83 and 84 are controlled by the CPU 32 as shown schematically in FIG. 1 in accordance with any suitable strategy.

The valve spools 81 and 82 are more specifically the lands formed thereon control the delivery of oil to three passages formed in each of the bearing surfaces 57 and 58. The first of these passages, indicated by the reference numerals 87 and 88, respectively are basically always open and provide a small amount of lubricant for lubricating the bearing surfaces 57 and 58 of the cylinder head, the corresponding surfaces of the bearing caps 59 and 61 and the bearing surfaces 55 and 56 of the camshafts 43 and 52, respectively.

In addition, there is larger advancing side passages 89 and 91, respectively, that supply lubricant to the variable valve timing mechanism 66 and 67, respectively, so as to advance the timing of the camshafts 43 and 52, respectively. When the valve timing is to be advanced, the passages 89 and 91 are pressurized by moving the spools 81 and 82 in the appropriate direction.

When advancing, retarding passages 92 and 93 in the surfaces 57 and 58, respectively, permit lubricant to flow out of the respective retarding sides of the variable valve timing mechanisms 66 and 67. Assuming the timing is being advanced, the passages 92 and 93 permit lubricant to flow into the interior of the valve spools 82 and 82, respectively. This lubricant is then discharged through discharge passages 94 and 95 formed coaxially in the valve spools 81 and 82.

This lubricant is then returned to a void area 96 formed by a core in the casting of the cylinder head 13 and which area drains through the appropriate drain passages (not shown) in the cylinder head 13 and associated cylinder block for returning the lubricant to the oil reservoir.

If retardation in the valve timing is required, the retarding passages 92 and 93 are pressurized and the advancing passages 89 and 91 act as return paths.

Figure 6:
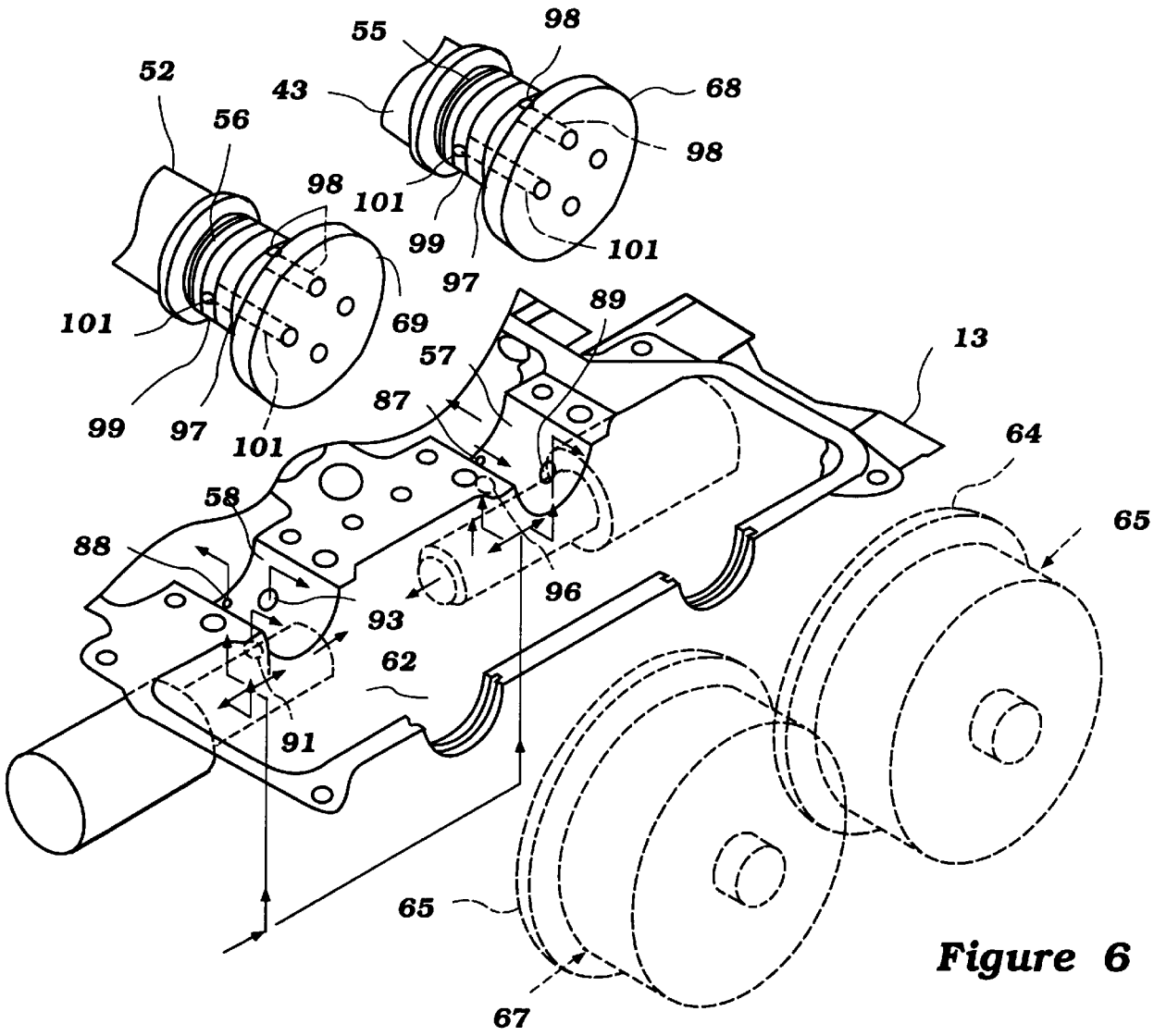
FIG. 6 is an exploded perspective view showing the same area of the cylinder head but depicting all of the components associated therewith except for the bearing cap and cam cover.

As best seen in FIG. 6, the advance passages 89 and 91 cooperate with a land 97 formed in each of the camshafts 43 and 52, which, in turn, communicates with a drilled passageway 98 for delivering lubricant to the advancing side of the respective variable valve timing mechanisms 66 and 67.

The retardation openings 87 and 93 communicate with a further land 99 formed in each of the camshafts 43 and 52 which, in turn, communicates with a drilled passage 101 formed in the respective camshaft for delivering lubricant to or returning it from the retardation side of the respective variable valve timing mechanism 66 or 67.

Hence from the foregoing description, it should be readily apparent that the lubrication of the camshafts and the delivery of lubricant to the variable valve timing mechanisms for their actuation is all done with the internal passageway. Thus, external conduits are eliminated and sealing problems are substantially reduced. In addition, a relatively compact cylinder head construction can be provided without sacrificing any of the benefits of the valve actuating mechanism and variable valve timing mechanism. Of course, the foregoing description is that of a preferred embodiment of the invention and various changes and modifications may be made without departing from the spirit and scope of the invention, as defined by the appended claims.

We claim:

1. An internal combustion engine comprised of an engine body, a camshaft having at least one bearing portion journalled for rotation about a camshaft axis in said engine body, said camshaft having at least one cam lobe for operating at least one valve for said engine, a cam driving element driven by an engine output shaft in timed relationship therewith, a hydraulically operated variable valve timing mechanism adjustably coupling said cam driving element to said camshaft for driving said camshaft and for adjusting the timing of said camshaft relative to said engine output shaft, means forming a lubricant passage, a return passage and a hydraulic supply passage in the said engine body and terminating at said camshaft one bearing portion at different axial locations for supply lubricant for lubricating said camshaft one bearing portion and for supplying and exhausting lubricant for actuating said variable valve timing mechanism, a valve bore formed in said engine body extending transversely to said camshaft axis, and a reciprocal valve spool received in said valve bore for controlling the supply and exhaust of lubricant for actuating said variable valve timing mechanism.

2. An internal combustion engine as set forth in claim 1, wherein at least the hydraulic supply passage and the return passage intersect the valve bore.

3. An internal combustion engine as set forth in claim 1, further including a second camshaft journaled within the engine body in parallel relationship to the first mentioned camshaft and provided with a bearing portion, a cam driving element, a hydraulic variable valve timing mechanism, lubricant and hydraulic supply and return passages, valve bore and valve spool all related as set forth in claim 1.

4. An internal combustion engine as set forth in claim 3, wherein at least the hydraulic supply passages and the return passages associated with each camshaft intersect the respective valve bore.

5. An internal combustion engine as set forth in claim 4, wherein the return passages for each of the camshaft bearing portions communicate with a common return passage formed in the engine body through the respective valve spool.

6. An internal combustion engine as set forth in claim 1, wherein the engine body comprises a cylinder head having a bearing surface cooperating with the camshaft one bearing portion and a bearing cap affixed to the cylinder head and further defining a bearing surface that cooperates with the camshaft one bearing portion for journaling the camshaft in the cylinder head.

7. An internal combustion engine as set forth in claim 6, wherein at least the hydraulic supply passage and the return passage intersect the valve bore.

8. An internal combustion engine as set forth in claim 6, further including a second camshaft journaled within the cylinder head in parallel relationship to the first mentioned camshaft and provided with a bearing portion, a cam driving element, a hydraulic variable valve timing mechanism, lubricant and hydraulic supply and return passages, valve bore and valve spool all related as set forth in claim 6.

9. An internal combustion engine as set forth in claim 8, wherein at least the hydraulic supply passages and the return passages associated with each camshaft intersect the respective valve bore.

10. An internal combustion engine as set forth in claim 9, wherein the return passages for each of the camshaft bearing portions communicate with a common return passage formed in the cylinder head through the respective valve spool.

11. An internal combustion engine as set forth in claim 10, wherein a further passage communicates with a main supply passage in the cylinder head in which a removable filter element is positioned.

12. An internal combustion engine as set forth in claim 11, wherein the main supply passage opens through an outer, exposed surface of the cylinder head through which the filter element may be removed and which is closed by a removable plug.

* * * * *